US009175508B1

(12) United States Patent
Steele

(10) Patent No.: US 9,175,508 B1
(45) **Date of Patent: *Nov. 3, 2015**

(54) METAL DOOR

(71) Applicant: Ryan D. Steele, Springfield, NE (US)

(72) Inventor: Ryan D. Steele, Springfield, NE (US)

( * ) Notice: Subject to any disclaimer, the term of this patent is extended or adjusted under 35 U.S.C. 154(b) by 59 days.

This patent is subject to a terminal disclaimer.

(21) Appl. No.: 14/505,919

(22) Filed: Oct. 3, 2014

Related U.S. Application Data

(63) Continuation-in-part of application No. 14/300,743, filed on Jun. 10, 2014.

(51) Int. Cl.

| | |
|---|---|
| ***E04C 2/54*** | (2006.01) |
| ***E06B 3/72*** | (2006.01) |
| ***E06B 3/70*** | (2006.01) |
| ***E06B 3/76*** | (2006.01) |

(52) U.S. Cl.
CPC ..... *E06B 3/728* (2013.01); *E06B 3/7001* (2013.01); *E06B 3/76* (2013.01)

(58) Field of Classification Search
CPC .... E06B 3/726; E06B 2003/346; E06B 3/728
USPC ..... 52/784.15, 800.13, 792.1, 784.13, 211
See application file for complete search history.

(56) References Cited

U.S. PATENT DOCUMENTS

| | | | | |
|---|---|---|---|---|
| 4,327,535 | A * | 5/1982 | Governale | 52/309.11 |
| 4,430,836 | A * | 2/1984 | McKann | 52/455 |
| 4,546,585 | A * | 10/1985 | Governale | 52/309.11 |
| 5,074,087 | A * | 12/1991 | Green | 52/309.9 |
| 5,077,948 | A * | 1/1992 | Olson et al. | 52/309.9 |
| 5,105,597 | A * | 4/1992 | Wilkening | 52/455 |
| 5,644,870 | A * | 7/1997 | Chen | 49/501 |
| 5,749,184 | A * | 5/1998 | McKann | 52/204.1 |
| 6,068,802 | A * | 5/2000 | Berghorn et al. | 264/46.5 |
| 6,311,454 | B1 * | 11/2001 | Kempel | 52/784.15 |
| 6,729,095 | B2 * | 5/2004 | Wang Chen | 52/456 |
| 7,748,120 | B2 * | 7/2010 | Turner et al. | 29/897.31 |
| 8,534,027 | B1 * | 9/2013 | Cullinane et al. | 52/784.15 |
| 8,656,684 | B1 | 2/2014 | Cullinane | |

* cited by examiner

*Primary Examiner* — Basil Katcheves
(74) *Attorney, Agent, or Firm* — Dennis L. Thomte; Thomte Patent Law Office LLC

(57) ABSTRACT

A metal door comprising first and second side frames or stiles and upper and lower frames or rails which are joined together. Each of the frames includes front and rear panels which are spaced apart and which are secured together by means of insulating panel connectors. The space between the panel connectors in each of the frames is filled with an insulating foam material. The panel connectors are also comprised of an insulating material such as wood, fiberglass, plastic or other insulative material.

14 Claims, 8 Drawing Sheets

METAL DOOR

CROSS REFERENCE TO RELATED APPLICATION

This is a Continuation-In-Part application of application Ser. No. 14/300,743, filed Jun. 10, 2014 entitled METAL DOOR.

BACKGROUND OF THE INVENTION

1. Field of the Invention

This invention relates to a metal door and more particularly to a metal door including first and second side frames or stiles and upper and lower frames or rails. Even more particularly, the first and second side frames have identical structures and the upper and lower frames have identical structures. Each of the frames has a metal front panel and a metal back panel which is spaced rearwardly of the front panel. Spaced-apart insulating panel connectors are positioned between the front and rear panels and are secured thereto to secure the front and rear panels together. An insulating foam material is positioned between the panel connectors.

2. Description of the Related Art

Many types of metal doors have been previously provided. The metal doors of the prior art are very durable and are resistant to forced entry attempts by burglars or the like. A problem associated with the metal doors of the prior art is encountered when the metal doors are subjected to cold temperatures. In such a situation, the inside portion of the metal doors of the prior art may "frost-up" when the metal doors are subjected to very cold temperatures.

Applicant's earlier metal doors, such as described in U.S. Pat. Nos. 8,534,027 and 8,656,684, represent distinct improvements in the metal door art. However, since the exterior and interior panel members of the '027 and '684 patents were each constructed of tubular steel members, the doors thereof are quite heavy. The invention set forth in the co-pending application represents an improvement in the art. The instant invention represents a further improvement in the metal door art.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A metal door is disclosed which includes vertically disposed and vertically extending first and second side frames or stiles and horizontally disposed and horizontally extending upper and lower frames or rails. One end of the upper frame is secured to the upper end of the first side frame with the other end of the upper frame being secured to the upper end of the second side frame. One end of the lower frame is secured to the lower end of the first side frame and the other end of the lower frame is secured to the lower end of the second side frame.

The first side frame includes horizontally spaced-apart front and rear panels which are connected together by means of a pair of panel connectors positioned therebetween. The panel connectors are comprised of an insulating material such as wood, fiberglass or plastic. The space between the panel connectors in the first side frame is filled with an insulating foam material. The second side frame of the door is identical to the first side frame. The upper frame or rail includes spaced-apart front and rear panels which are connected together by a pair of insulating panel connectors. The space between the panel connectors in the upper frames is filled with an insulating foam material. The lower frame or rail is identical to the upper frame.

An optional intermediate frame may be extended between the first and second side frames above the lower end of the door if so desired. The intermediate frame will have the same construction as the upper and lower frames and may be straight or curved.

A door frame is also disclosed in which the door is positioned. The door frame also includes insulating material therein.

A principal object of the invention is to provide an improved metal door.

A further object of the invention is to provide an improved metal door which has improved insulation therein.

A further object of the invention is to provide an improved metal door wherein the door includes a first side frame, a second side frame, an upper frame and a lower frame wherein each of the frames include front and rear panels which are connected together by insulating panel connectors which have insulating foam material therebetween.

A further object of the invention is to provide an improved metal door which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention.

However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
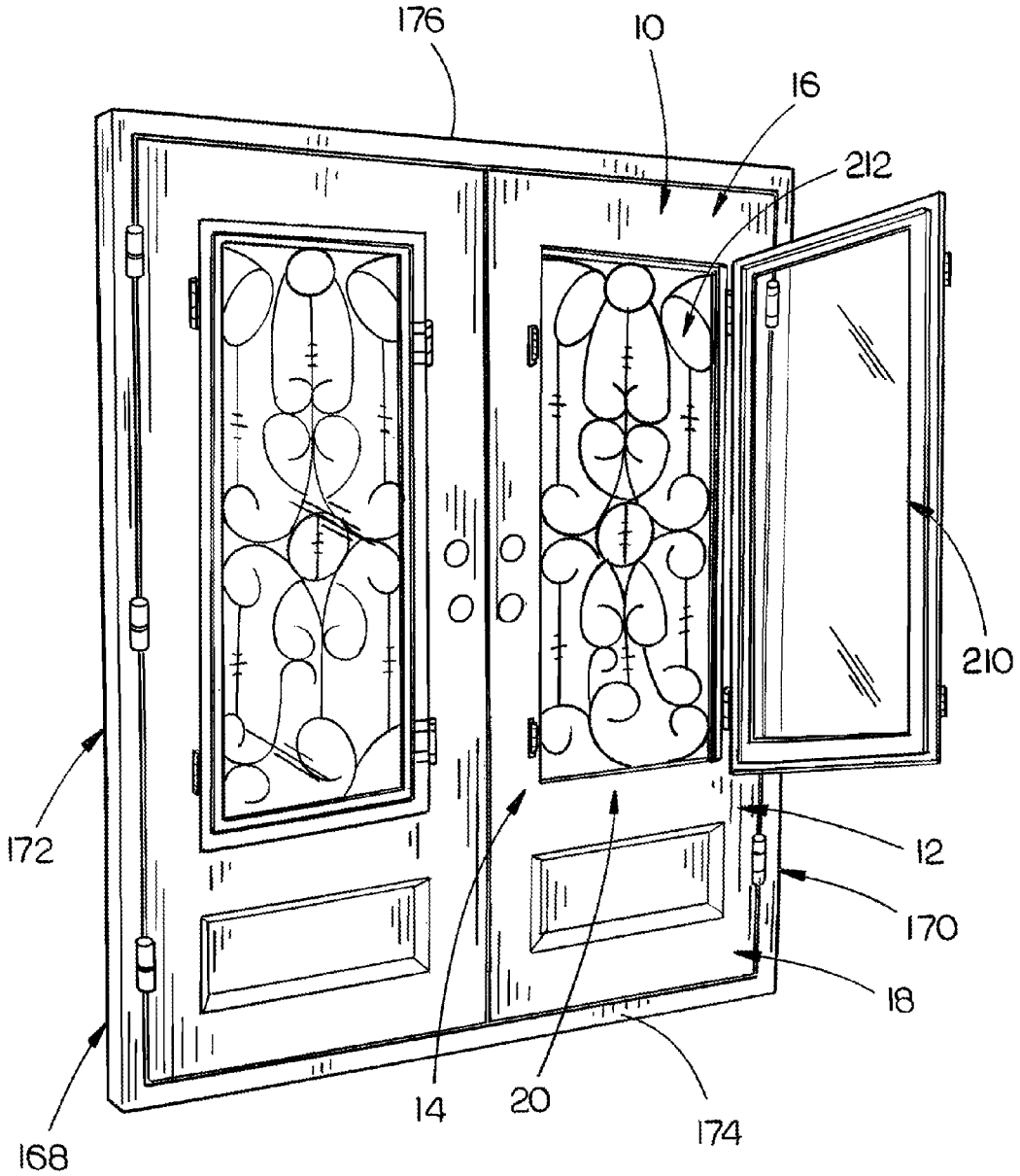
FIG. 1 is an interior perspective view of a pair of metal doors of this invention.
Figure 2:
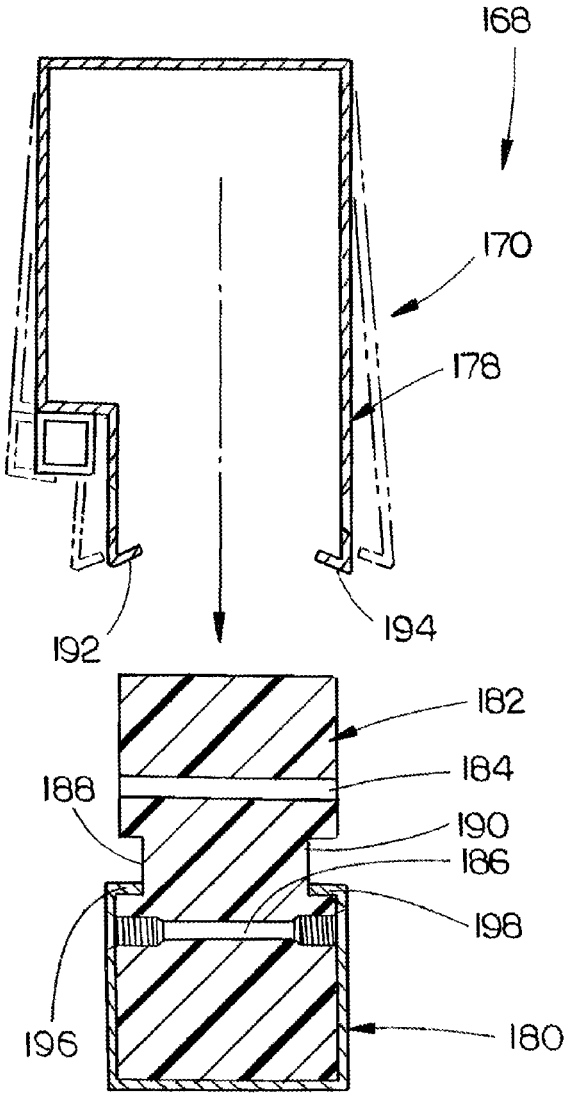
FIG. 2 is an exploded sectional view of the leg or jamb of the door frame in which the door of this invention is mounted.
Figure 3:
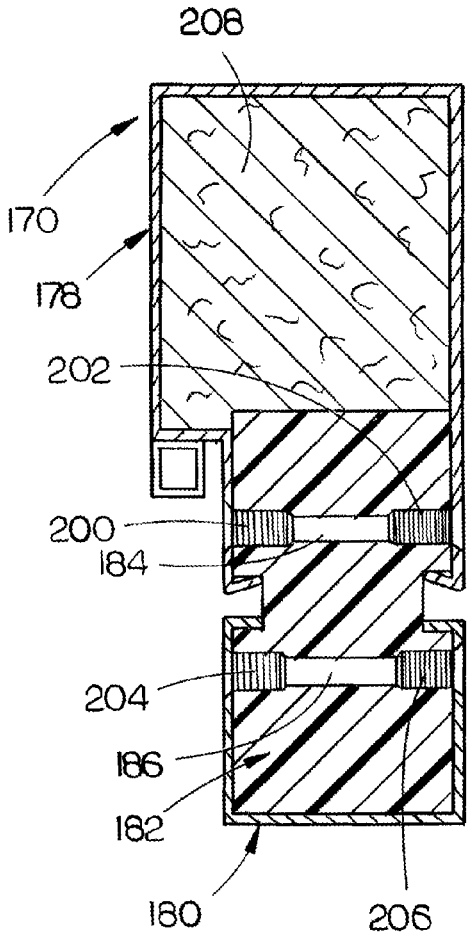
FIG. 3 is a sectional view of the leg or jamb of the door frame of FIG. 2 after the leg or jamb is assembled.

The metal door of this invention is designated by the reference numeral 10 and includes a vertically disposed first side frame or hinge stile 12, a vertically disposed second side frame or lock stile 14, a horizontally disposed upper frame or top rail 16, a horizontally disposed lower frame or bottom rail 18, and an optional intermediate frame or rail 20 which extends between side frames 12 and 14 between the upper frame 16 and the lower frame 18. Frame 20 may be straight or curved. The door 10 shown herein will be inwardly hinged at the right side thereof as viewed from the interior thereof (FIG. 1). The door could be inwardly hinged at the left side thereof if so desired, as shown in FIG. 1. The door 10 could be outwardly hinged if so desired.

Side frame or stile 12 will be described as having an upper end 22, a lower end 24, an inner end 26, an outer end 28, an exterior front side 30 and an interior rear side 32. Side frame 12 includes a vertically disposed metal front or exterior panel 34 and a vertically disposed metal rear or interior panel 36 which is spaced rearwardly of front panel 34. A flange 38 extends transversely rearwardly from the outer end of front panel 34. A flange 40 extends inwardly from the rearward end of flange 38. A flange 42 extends transversely rearwardly from the inner end of front panel 34. A flange 44 extends outwardly from the rearward end of flange 42.

A flange 46 extends transversely forwardly from the outer end of rear panel 56. A flange 48 extends inwardly from the forward end of flange 46. A flange 50 extends transversely forwardly from the inner end of rear panel 36. A flange 52 extends outwardly from the forward end of flange 50.

The numeral 54 refers to a vertically disposed and vertically extending panel connector which is comprised of wood, fiberglass, plastic or other insulative material and which has an upper end, a lower end, a front side 56, a rear side 58, an outer side 60 and an inner side 62. A vertically disposed slot or groove 64 is formed in the outer side 60 of panel connector 54. Panel connector 54 has a plurality of vertically spaced-apart bolt openings 66 formed therein. A plurality of vertically spaced-apart bolts 68 have the heads 70 thereof welded to front panel 34 and are received in the bolt openings 66. Nuts 72 secure the panel connector 54 to front panel 34. Panel connector 54 is positioned between front panel 34 and rear panel 36 at the outer end thereof inwardly of flanges 38 and 46 so that flange 40 of front panel 34 and flange 48 of rear panel 36 are received in slot 64. Although it is preferred that panel connector 54 is secured to the panel 34 as described, the bolts 68 could be extended through the panel connector 54 so that the heads 70 thereof are received in the inner ends of the bolt openings 66 with the outer ends of the bolts 68 being welded to the panel 34. In that method, there is no need for the nuts 72.

Figure 4:
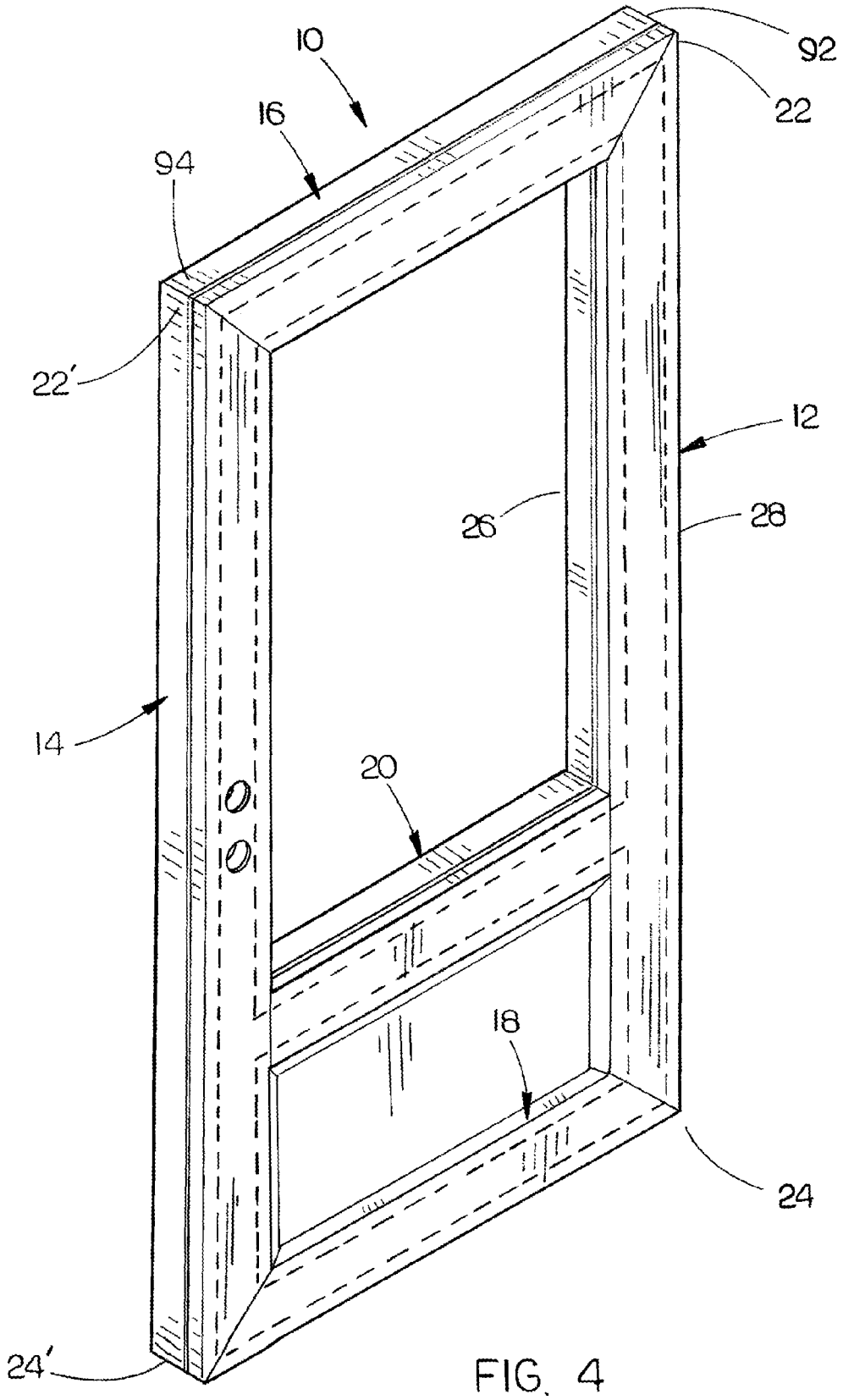
FIG. 4 is an interior elevational perspective view of the door of this invention.
Figure 5:
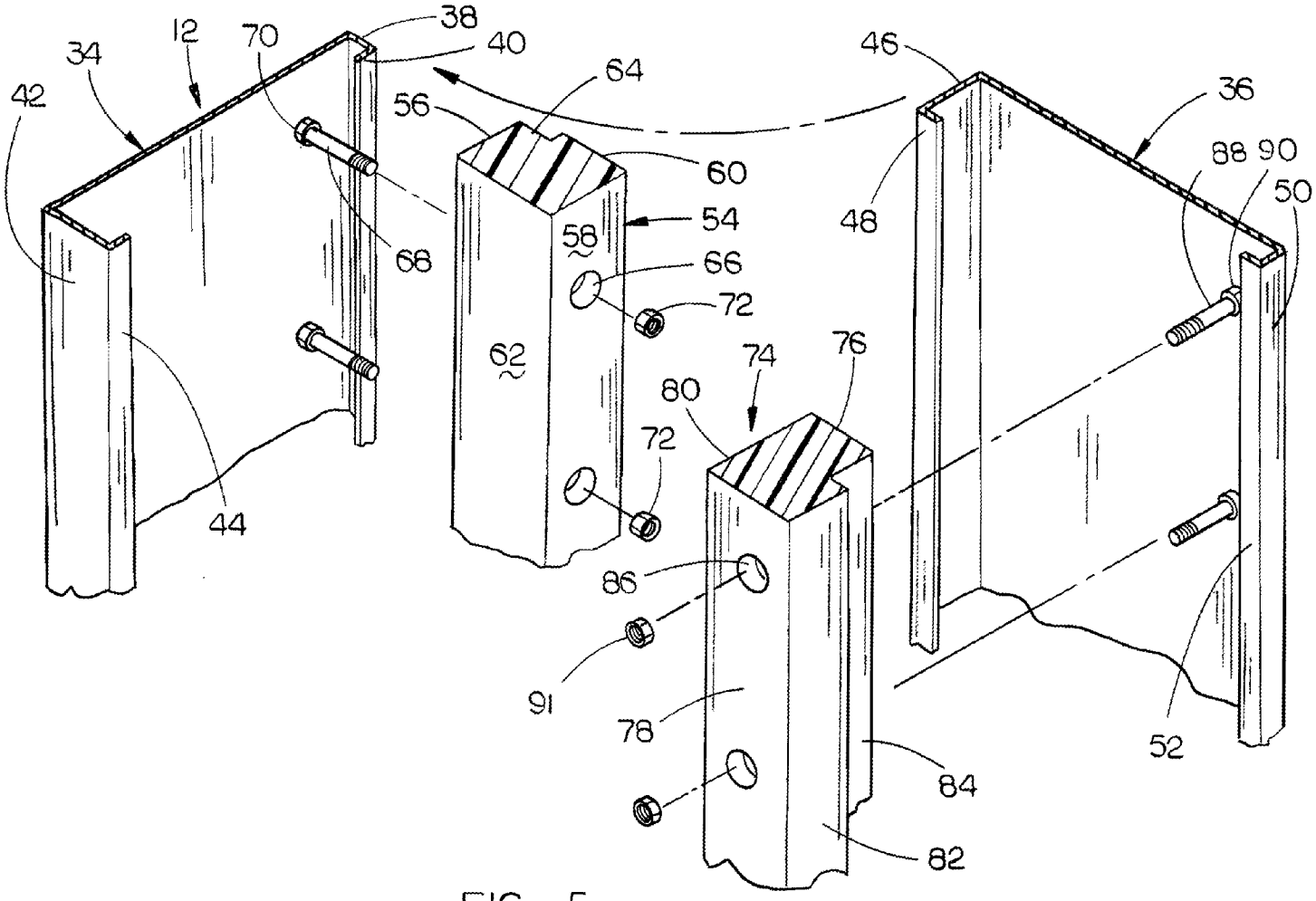
FIG. 5 is an exploded perspective view of the first side frame or stile of the door of this invention.
Figure 6:
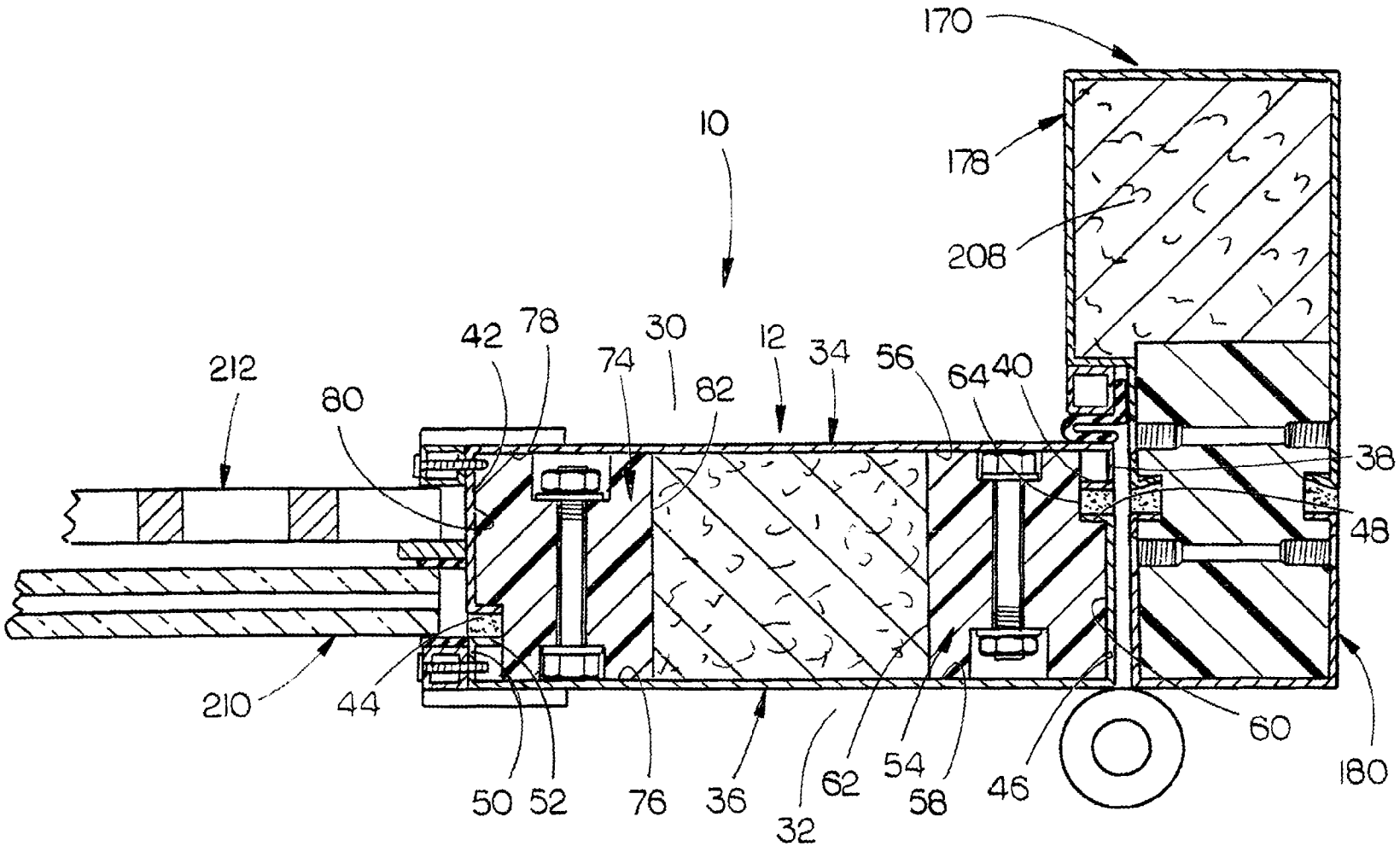
FIG. 6 is a partial sectional view of the first side frame or stile of this invention and the leg or jamb of the door frame.
Figure 7:
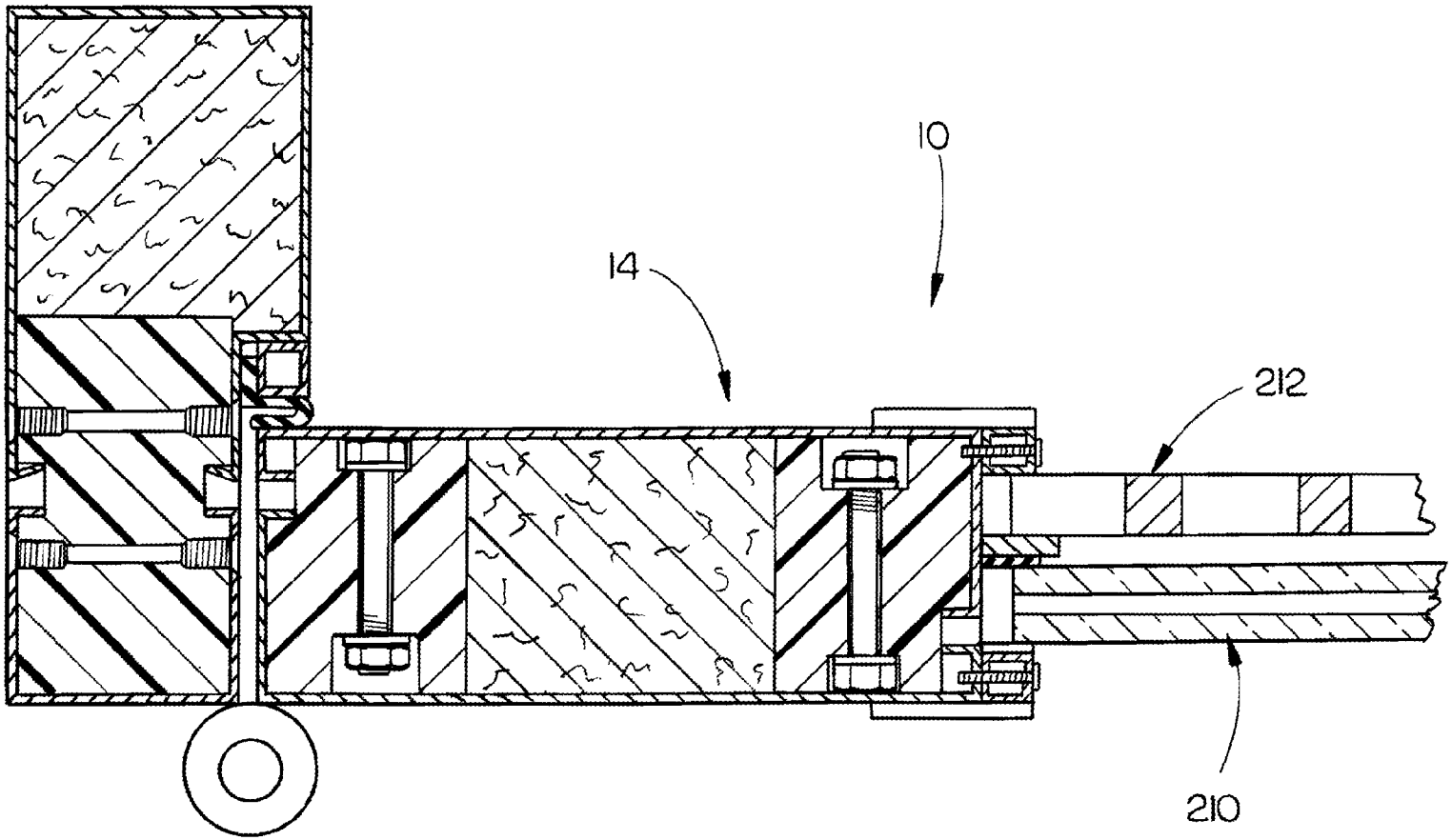
FIG. 7 is a partial sectional view of the second side frame or stile of the door of this invention.
Figure 9:
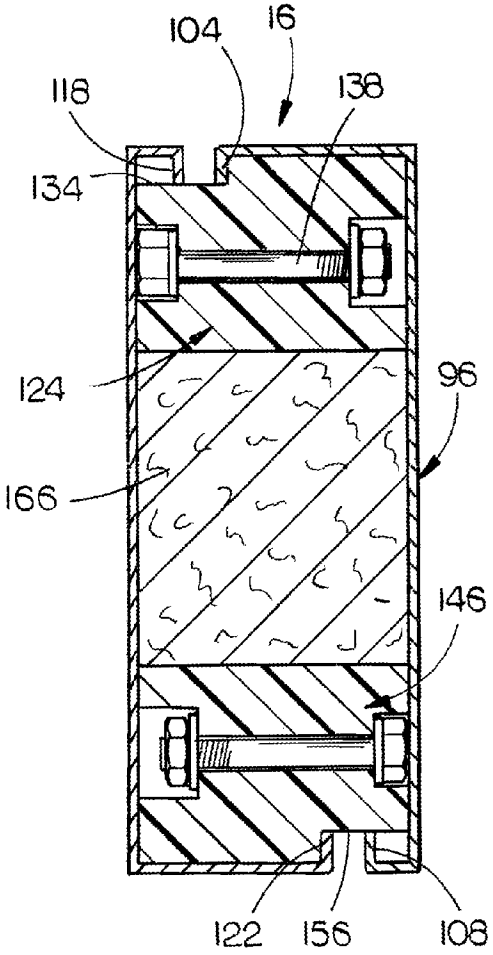
FIG. 9 is a sectional view of the upper frame of the door or rail of this invention in its assembled position.
Figure 8:
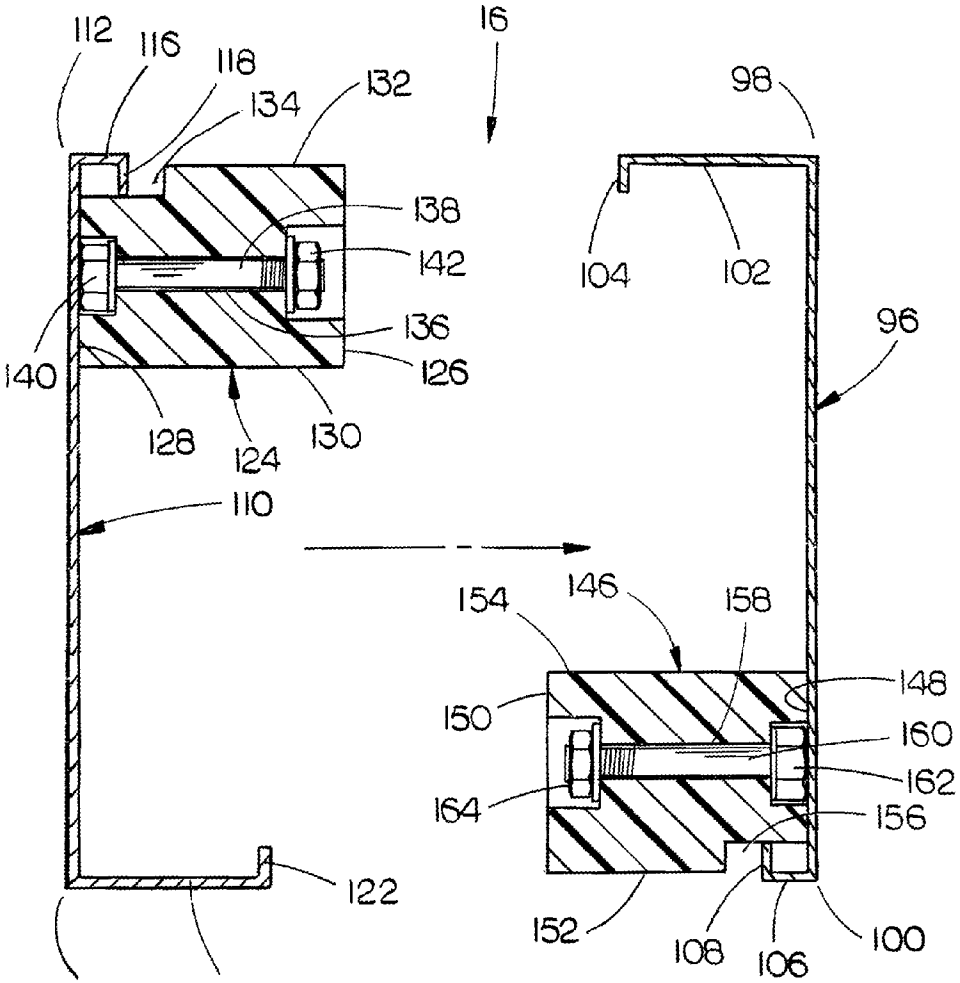
FIG. 8 is an exploded sectional view of the upper frame or rail of the door of this invention.
Figure 11:
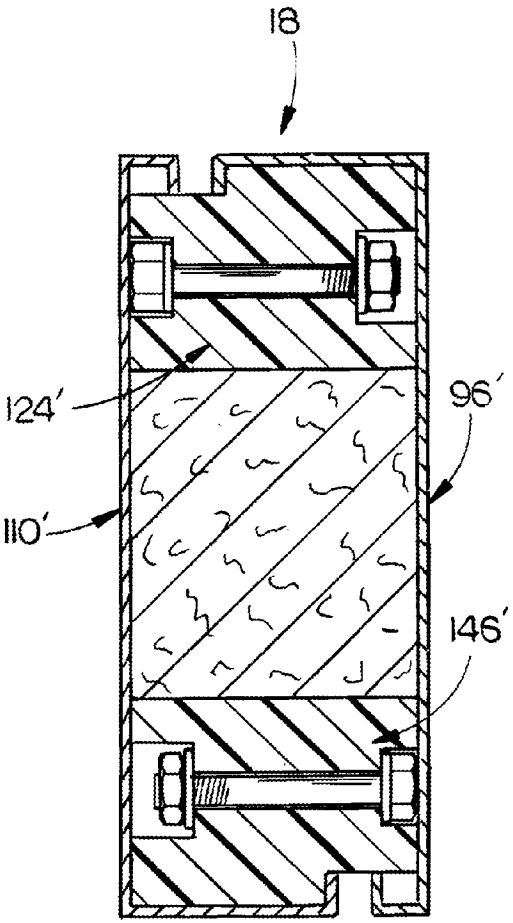
FIG. 11 is a sectional view of the lower frame or rail of the door of this invention in its assembled position.
Figure 10:
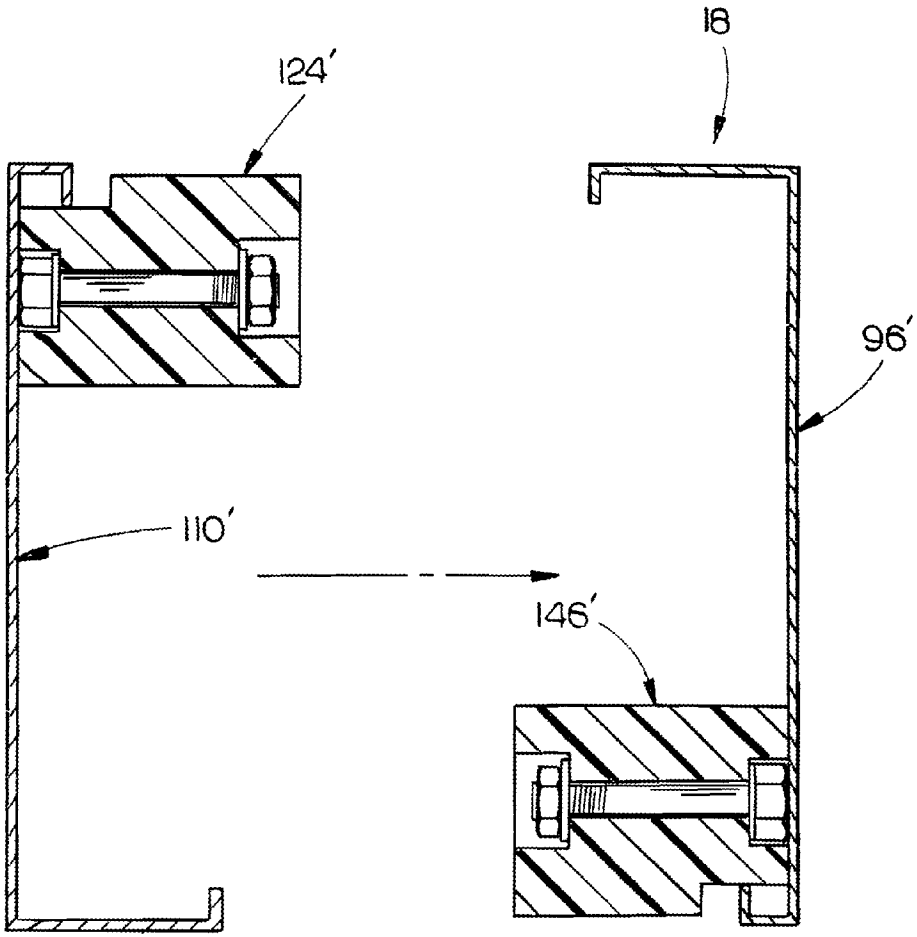
FIG. 10 is an exploded sectional view of the lower frame or rail of the door of this invention.

The numeral 74 refers to a vertically disposed and vertically extending panel connector which is comprised of wood, fiberglass, plastic or other insulative material and which has an upper end, a lower end, a rear end 76, a front end 78, an outer side 80, and an inner side 82. A vertically disposed slot 84 is formed in the inner side of panel connector 74. Panel connector 74 has a plurality of vertically spaced-apart bolt openings 86 formed therein. A plurality of vertically spaced-apart bolts 88 have the heads 90 thereof welded to rear panel 36 and are received in the bolt openings 86. Nuts 91 secure the panel connector 74 to rear panel 36. Although it is preferred that the panel connector 74 is secured to the panel 36 as described, the bolts 88 could be extended through the panel connector 74 so that the heads 90 thereof are received in the inner ends of the bolt openings 86 with the outer ends of bolts 88 being welded to the panel 36. In that method, there is no need for the nuts 91. The side frame 14 of door 10 is identical to side frame 12 and will not be described in detail for purposes of conciseness. In FIG. 4, the structure of the second side frame 14, which is identical to the structure of the first side frame 12, will be indicated with "'".

Upper frame 16 has a first end 92 which is secured to the upper end 22 of side frame 12 and a second end 94 which is secured to the upper end 22' of side frame 14. Upper frame 16 includes a vertically disposed metal front panel 96 having an upper end 98 and a lower end 100. A flange 102 extends transversely rearwardly from the upper end 98 of front panel 96. A flange 104 extends downwardly from the rearward end of flange 102. Flange 106 extends transversely rearwardly from the lower end 100 of front panel 96. Flange 108 extends upwardly from the rearward end of flange 96.

Upper frame 16 also includes a vertically disposed rear panel 110 having an upper end 112 and a lower end 114. A flange 116 extends transversely forwardly from the upper end 112 of rear panel 110. Flange 118 extends downwardly from the forward end of flange 116. Flange 120 extends transversely forwardly from the lower end 114 of rear panel 110. Flange 122 extends upwardly from the forward end of flange 120. An elongated and horizontally disposed panel connector 124 is positioned between front panel 96 and rear panel 110 of upper frame 16 at the upper end of upper frame 16. Panel connector 124 has a front side 126, a rear side 128, a lower end 130 and an upper end 132. The upper end 132 of panel connector 124 has a slot 134 formed therein which receives flange 104 of front panel 96 and flange 118 of rear panel 120. The slot 134 is filled with a caulking material. Panel connector 124 has a plurality of vertically spaced bolt openings 136 formed therein which receive bolt members 138 therein. The heads 140 of bolt members 138 are welded to rear panel 110. Nuts 142 are secured to bolt members 138 to secure panel connector 124 to rear panel 110. Panel connector 124 is comprised of wood, fiberglass, plastic or other insulative material.

Although it is preferred that the panel connector 124 is secured to the panel 110 as described, the bolts 138 could be extended through the panel connector 124 so that the heads 140 thereof are received in the inner ends of bolt openings 136 with the outer ends of the bolts 138 being welded to the panel 110.

An elongated and horizontally disposed panel connector 146 is positioned between front panel 96 and rear panel 110 of upper frame 16 at the lower end of upper frame 16. Panel connector 146 has a front side 148, a rear side 150, a lower end 152 and an upper end 154. The lower end 152 of panel connector 146 has a slot or groove 156 formed therein which receives the flange 108 of front panel 96 and flange 122 of rear panel 120. Slot 156 is filled with a caulking material. Panel connector 146 has a plurality of vertically spaced-apart bolt openings 158 formed therein which receive bolt members 160 therein. The heads 162 of bolt members 160 are welded to front panel 96 of upper frame 16. Nuts 164 are secured to the bolt members 160 to secure panel connector 146 to front panel 96. A foam insulation material 166 is positioned in upper frame 16 between the panel connectors 124 and 146. Although it is preferred that the panel connector 146 is secured to the panel 96 as described, the bolts 160 could be extended through the panel connector 146 so that the heads 162 thereof are received in the inner ends of bolt openings 158 with the outer ends of the bolts 160 being welded to the panel 96.

Lower frame 18 is secured to the lower ends of side frames 12 and 14 and extends therebetween. Lower frame 18 is identical to upper frame 16 and will not be described in detail. Identical structure of lower frame 18 to upper frame 16 will be designated with "'".

The door 10 is mounted in a door frame generally indicated by the reference numeral 168. Door frame 168 includes legs or jambs 170 and 172, a sill or threshold 174 and a head 176. Door frame 168 will obviously accommodate a single door 10 or a pair of doors such as seen in FIG. 1.

The legs or jambs 170 and 172 as well as the head 176 will normally be identical, so only jamb 170 will be described in detail. Jamb 170 includes a front metal unit 178 and a rear metal unit 180 which are secured to a panel connector 182 comprised of wood, fiberglass, plastic or other insulative material. Panel connector 182 has bores 184 and 186 extending therethrough. Panel connector 182 also has elongated slots 188 and 190 formed therein. The flanges 192 and 194 of front unit 170 are received in the slots 188 and 190. The flanges 196 and 198 are also received in the slots 188 and 190 of panel connector 182 respectively. Screws 200 and 202 extend through openings formed in front unit 178 into the ends of bore 184 to secure front unit 178 to panel connector 182. Screws 204 and 206 extend through openings formed in rear unit 180 into the ends of bore 186 of panel connector 182 to secure the rear unit 180 to panel connector 182. A foam insulation material 208 is positioned in front unit 178.

The door 10 will normally have a glass unit 210 mounted therein which is preferably hinged so as to be inwardly moveable, as seen in FIG. 1. Door 10 also will normally have a metal grill 212 mounted therein.

Thus, it can be seen that a metal door has been provided wherein the front and rear panels of the first side frame, the second side frame, the upper frame and the lower frame have a thermal break therebetween. It can therefore be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A door comprising:

a vertically disposed and vertically extending first side frame or stile having an upper end, a lower end, a front side, a rear side, an inner end and an outer end;

said first side frame including a vertically disposed metal front or exterior panel having an upper end, a lower end, an inner end, an outer end, a first flange extending transversely rearwardly from said outer end of said front panel, a second flange extending inwardly from the rearward end of said first flange, a third flange extending transversely rearwardly from said inner end of said front panel, a fourth flange extending outwardly from the rearward end of said third flange;

said first side frame also including a vertically disposed metal rear panel which is spaced rearwardly of said front panel and which has an upper end, a lower end, an inner end and an outer end, a first flange extending transversely forwardly from said outer end of said rear panel, a second flange extending inwardly from the forward end of said first flange, a third flange extending transversely forwardly from said inner end of said rear panel and a fourth flange extending outwardly from the forward end of said third flange;

said first side frame further including an elongated, vertically disposed first panel connector having an upper end, a lower end, an outer side and an inner side;

said first panel connector of said first side frame having a vertically disposed slot formed in said outer side thereof;

said first panel connector of said first side frame being positioned between said front and rear panels of said first side frame inwardly of said outer ends thereof with said vertically disposed slot in said first panel connector of said first side frame receiving said second flange of said front panel of said first side frame and said second flange of said rear panel of said first side frame therein;

said first panel connector of said first side frame being secured to said front and rear panels of said first side frame so that said second flange of said front panel of said first side frame is spaced forwardly of said second flange of said rear panel of said first side frame;

a caulking material in said slot in said first panel connector;

an elongated, vertically disposed second panel connector having an upper end, a lower end, an outer side, and an inner side;

said second panel connector of said first side frame having a vertically disposed slot formed in said inner side thereof;

said second panel connector of said first side frame being positioned between said front and rear panels of said first side frame with said vertically disposed slot in said second panel connector of said first side frame receiving said fourth flange of said front panel of said first side frame and said fourth flange of said rear panel of said first side frame therein;

said second panel connector of said first side frame being secured to said front and rear panels of said first side frame so that said fourth flange of said front panel of said first side frame is spaced forwardly of said fourth flange of said rear panel of said first side frame;

a caulking material in said slot in said second panel connector;

a foam insulation material in said lower frame between said first and second panel connectors thereof;

a vertically disposed second side frame having an upper end, a lower end, a front side, a rear side, an inner end and an outer end;

said second side frame including a vertically disposed metal front panel having an upper end, a lower end, an inner end, and an outer end, a first flange extending transversely rearwardly from said outer end of said front panel, a second flange extending inwardly from the rearward end of said first flange, a third flange extending transversely from said inner end of said front panel, a fourth flange extending outwardly from the rearward end of said third flange;

said second side frame also including a vertically disposed metal rear panel which is spaced rearwardly of said front panel thereof and which has an upper end, a lower end, an inner end and an outer end, a first flange extending transversely forwardly from said outer end of said rear panel, a second flange extending inwardly from the forward end of said first flange, a third flange extending transversely forwardly from said inner end of said rear panel and a fourth flange extending outwardly from the forward end of said third flange;

said second side frame further including an elongated, vertically disposed first panel connector having an upper end, a lower end, an outer side and an inner side;

said first panel connector of said second side frame having a vertically disposed slot formed in said inner side thereof;

said first panel connector of said second side frame being positioned between said front and rear panels of said second side frame inwardly of said inner ends thereof with said vertically disposed slot in said first panel connector of said second side frame receiving said second flange of said front panel of said second side frame and said second flange of said rear panel of said second side frame therein;

said first panel connector of said second side frame being secured to said front and rear panels of said second side frame so that said second flange of said front panel of said second side frame is spaced forwardly of said second flange of said rear panel of said second side frame;

an elongated, vertically disposed second panel connector having an upper end, a lower end, an outer side, and an inner side;

said second panel connector of said second side frame having a vertically disposed slot formed in said outer side thereof;

said second panel connector of said second side frame being positioned between said front and rear panels of said second side frame with said vertically disposed slot in said second panel connector of said second side frame receiving said second flange of said front panel of said second side frame and said second flange of said rear panel of said second side frame therein;

said second panel connector of said second side frame being secured to said front and rear panels of said second side frame so that said fourth flange of said front panel of said second side frame is spaced forwardly of said fourth flange of said rear panel of said second side frame;

a caulking material in said slot in said second panel connector of said second side frame;

a horizontally disposed and horizontally extending upper frame having a first end, a second end, a front side and a back side;

said first end of said upper frame being secured to said upper end of said first side frame;

said second end of said upper frame being secured to said upper end of said second side frame;

said upper frame including a vertically disposed metal front panel having an upper end, a lower end, a first end and a second end, a first flange extending transversely rearwardly from said upper end of said front panel of said upper frame;

a second flange extending downwardly from the rearward end of said first flange of said upper frame;

a third flange extending rearwardly from said lower end of said front panel of said upper frame;

a fourth flange extending upwardly from the rearward end of said front panel of said upper frame;

said upper frame also including a vertically disposed metal rear panel having an upper end, a lower end, a first end and a second end;

said rear panel of said upper frame being positioned rearwardly of said front panel of said upper frame;

a first flange extending forwardly from said upper end of said rear panel of said upper frame;

a second flange extending downwardly from the forward end of said first flange of said rear panel of said upper frame;

a third flange extending forwardly from said lower end of said rear panel of said upper frame;

a fourth flange extending upwardly from the forward end of said third flange of said rear panel of said upper frame;

said upper frame including a horizontally disposed and horizontally extending first panel connector having a first end, a second end, an upper side, a lower side, a front side and a rear side;

said first panel connector of said upper frame having a horizontally disposed slot formed in said upper side thereof;

said first panel connector of said upper frame being positioned between said front and rear panels of said upper frame whereby said second flange of said front panel of said upper frame and said second flange of said rear panel are received in said slot formed in said first panel connector of said upper frame;

said first panel connector of said upper frame being secured to said front and rear panels of said upper frame;

a caulking material in said slot in said first panel connector of said upper frame;

said upper frame also including a horizontally disposed and horizontally extending second panel connector having a first end, a second end, an upper side, a lower side, a front side and a rear side;

said second panel connector of said upper frame having a horizontally disposed slot formed in said lower side thereof;

said second panel connector of said upper frame being positioned between said front and rear panels of said upper frame whereby said fourth flange of said front panel of said upper frame and said fourth flange of said rear panel are received in said slot formed in said second panel connector of said upper frame;

a caulking material in said slot in said second panel connector of said upper frame;

a horizontally disposed and horizontally extending lower frame having a first end, a second end, a front side and a back side;

said first end of said lower frame being secured to said lower end of said first side frame;

said second end of said lower frame being secured to said lower end of said second side frame;

said lower frame including a vertically disposed metal front panel having an upper end, a lower end, a first end and a second end, a first flange extending transversely rearwardly from said upper end of said front panel of said lower frame;

a second flange extending downwardly from the rearward end of said first flange of said lower frame;

a third flange extending rearwardly from said lower end of said front panel of said lower frame;

a fourth flange extending upwardly from the rearward end of said third flange of said upper frame;

said lower frame also including a vertically disposed metal rear panel having an upper end, a lower end, a first end and a second end;

said rear panel of said lower frame being positioned rearwardly of said front panel of said lower frame;

a first flange extending forwardly from said upper end of said rear panel of said lower frame;

a second flange extending downwardly from the forward end of said first flange of said rear panel of said upper frame of said lower frame;

a third flange extending forwardly from said lower end of said rear panel of said lower frame;

a fourth flange extending upwardly from the forward end of said third flange of said rear panel of said upper frame of said lower frame;

said lower frame including a horizontally disposed and horizontally extending first panel connector having a first end, a second end, an upper side, a lower side, a front side and a rear side;

said first panel connector of said lower frame having a horizontally disposed slot formed in said upper side thereof;

said first panel connector of said lower frame being positioned between said front and rear panels of said lower frame whereby said second flange of said front panel of said lower frame and said second flange of said rear panel of said lower frame are received in said slot formed in said first panel connector of said lower frame;

said first panel connector of said lower frame being secured to said front and rear panels of said lower frame;

a caulking material in said slot in said first panel connector of said lower frame;

said lower frame including a horizontally disposed and horizontally extending second panel connector having a first end, a second end, an upper side, a lower side, a front side and a rear side;

said second panel connector of said lower frame having a horizontally disposed slot formed in said lower side thereof;

said second panel connector of said lower frame being positioned between said front and rear panels of said lower frame whereby said fourth flange of said front panel of said lower frame and said fourth flange of said rear panel of said lower frame are received in said slot formed in said second panel connector of said lower frame;

said second panel connector of said lower frame being secured to said front and rear panels of said lower frame;

a caulking material in said slot in said second panel connector of said lower frame.

2. The door of claim 1 wherein said panel connectors are comprised of an insulating material.

3. The door of claim 1 wherein said panel connectors are comprised of wood.

4. The door of claim 1 wherein said panel connectors are comprised of plastic.

5. The door of claim 1 wherein said panel connectors are comprised of fiberglass.

6. The door of claim 1 wherein an intermediate frame is secured to and extends between said first and second side frames above said lower ends thereof.

7. The door of claim 1 wherein an insulated glass member is positioned between said front and second side frames.

8. The door of claim 1 wherein said panel connectors are secured to said front and rear panels by bolts.

9. The door of claim 1 wherein the door is mounted in a door frame including first and second vertically disposed jambs which include insulative material.

10. The door of claim 9 wherein one of said first and second side frames is hingedly secured to one of said jambs.

11. The door of claim 9 wherein said jambs extend forwardly from said outer ends of said first and second side frames.

12. The door of claim 9 wherein said jambs include insulation means for preventing the passage of cold temperature therethrough.

13. A metal door, comprising:

a vertically disposed first side frame having an upper end, a lower end, an inner end, an outer end, a front side and a rear side;

a vertically disposed second side frame having an upper end, a lower end, an inner end, an outer end, a front side and a rear side;

a horizontally disposed upper frame having a first end, a second end, an upper end, a lower end, a front side and a rear side;

said first end of said upper frame being joined to said upper end of said first side frame;

said second end of said upper frame being joined to said upper end of said second frame;

a horizontally disposed lower frame having a first end, a second end, an upper end, a lower end, a front side and a back side;

said first end of said lower frame being joined to said lower end of said first side frame;

said second end of said lower frame being joined to said lower end of said second side frame;

said first side frame including spaced-apart front and rear panels which are comprised of a metal material;

a pair of spaced-apart insulated connectors positioned between said front and rear panels of said first side frame which are connected to said front and rear panels to maintain said front and rear panels of said first side frame in a spaced-apart position and to provide a thermal break between said front and rear panels of said first side frame;

said second side frame including spaced-apart front and rear panels being comprised of a metal material;

a pair of spaced-apart insulated connectors positioned between said front and rear panels of said second side frame which are connected to said front and rear panels of said second side frame to maintain said front and rear panels of said second side frame in a spaced-apart position and to provide a thermal break between said front and rear panels of said second side frame;

said upper frame including spaced-apart front and rear panels which are comprised of a metal material;

a pair of spaced-apart insulated connectors positioned between said front and rear panels of said upper frame which are connected to said front and rear panels of said upper frame to maintain said front and rear panels of said upper frame in a spaced-apart position and to provide a thermal break between said front and rear panels of said upper frame;

said lower frame including spaced-apart front and rear panels which are comprised of a metal material;

a pair of spaced-apart insulated connectors positioned between said front and rear panels of said lower frame which are connected to said front and rear panels of said lower frame to maintain said front and rear panels of said lower frame in a spaced-apart position and to provide a thermal break between said front and rear panels of said lower frame;

and an insulation means positioned between said connectors of said first side frame, said connectors of said second side frame, said connectors of said upper frame and said connectors of said lower frame.

14. The metal door of claim 13 wherein each of said front and rear panels of each of said first side frame, said second side frame, said upper frame and said lower frame have flanges extending therefrom which are received by the respective connectors.

* * * * *